US006710020B2

(12) United States Patent
Tenne et al.

(10) Patent No.: US 6,710,020 B2
(45) Date of Patent: Mar. 23, 2004

(54) HOLLOW FULLERENE-LIKE NANOPARTICLES AS SOLID LUBRICANTS IN COMPOSITE METAL MATRICES

(75) Inventors: Reshef Tenne, Rehovot (IL); Lev Rapoport, Lod (IL); Mark Lvovsky, Herzliya (IL); Yishay Feldman, Ashdod (IL); Volf Leshchinsky, Rishon Letzion (IL)

(73) Assignees: Yeda Research and Development Co. Ltd., Rehovot (IL); Holon Academic Institute of Technology, Holon (IL)

( * ) Notice: Subject to any disclaimer, the term of this patent is extended or adjusted under 35 U.S.C. 154(b) by 0 days.

(21) Appl. No.: 10/220,596

(22) PCT Filed: Mar. 5, 2001

(86) PCT No.: PCT/IL01/00204

§ 371 (c)(1),
(2), (4) Date: Dec. 19, 2002

(87) PCT Pub. No.: WO01/66676

PCT Pub. Date: Sep. 13, 2001

(65) Prior Publication Data

US 2003/0144155 A1 Jul. 31, 2003

(30) Foreign Application Priority Data

Mar. 6, 2000 (IL) ..... 134892

(51) Int. Cl.[7] ..... B22F 3/26; C10M 171/06; C22C 32/00

(52) U.S. Cl. ..... 508/103; 508/107; 508/108; 419/27; 428/548; 428/620

(58) Field of Search ..... 508/103, 104, 508/105; 419/27

(56) References Cited

U.S. PATENT DOCUMENTS 3,956,146 A * 5/1976 Tsuya et al. ..... 75/231
6,015,775 A * 1/2000 Takayama et al. ..... 508/103
6,217,843 B1 * 4/2001 Homyonfer et al. ..... 423/593.1
6,245,718 B1 * 6/2001 Romanov et al. ..... 508/105

FOREIGN PATENT DOCUMENTS

WO WO 97/44278 11/1997
WO WO 99/44955 9/1999

OTHER PUBLICATIONS

Chemical Abstract No. 131:202004, Rapoport et al., "The Effect of Hollow Nanoparticles of $WS_2$ on Friction and Wear".

Iijima, "Helical Microtubules of Graphitic Carbon", *Nature*, vol. 354, pp. 56–58 (Nov. 7, 1991).

Kroto et al., "$C_{60}$: Buckminsterfullerene", *Nature*, vol. 318, pp. 162–163 (Nov. 14, 1985).

Chopra et al., Boron Nitride Nanotubes, *Science*, vol. 269, pp. 966–967 (Aug. 18, 1996).

Feldman et al., "High–Rate, Gas–Phase Growth of $MoS_2$ Nested Inorganic Fullerenes and Nanotubes", *Science*, vol. 267, pp. 222–225 (Jan. 13, 1995).

(List continued on next page.)

*Primary Examiner*—Ellen M. McAvoy
(74) *Attorney, Agent, or Firm*—Browdy and Neimark, P.L.L.C.

(57) ABSTRACT

The present invention provides a new composite material comprising a porous matrix made of metal, metal alloy or semiconducting material and hollow fullerene-like nanoparticles of a metal chalcogenide compound or mixture of such compounds. The composite material is characterized by having a porosity between about 10% and about 40%. The amount of the hallow nanoparticles in the composite material is 1–20 wt. %.

17 Claims, 7 Drawing Sheets

OTHER PUBLICATIONS

Rothschild et al., "Growth of $WS_2$ Nanotubes Phases", *J. Am. Chem. Soc.*, vol. 122, pp. 5169–5179 (2000).

Tenne et al., "Polyhedral and Cylindrical Structures of Tungsten Disulphide", *Nature*, vol. .360, pp. 444–445 (Dec. 3, 1992).

*Fundamentals of Friction: Macroscopic and Microscopic Processes*, edited by Singer et al., NATO ASI Series, Dordrecht: Kluwer Academic Publishers (1992), pp. 237–261.

Rapoport et al., "Hollow Nanoparticles of $WS_2$ as Potential Solid–State Lubricants", reprinted from *Nature*, vol. 387 (Jun. 19, 1997).

* cited by examiner

10μm

2μm

ENT = 20.00kV WD = 25mm

HOLLOW FULLERENE-LIKE NANOPARTICLES AS SOLID LUBRICANTS IN COMPOSITE METAL MATRICES

FIELD OF THE INVENTION

This invention relates to solid lubricants for metals, metal alloys and semiconducting materials. The invention is particularly useful in applications such as automotive transport, aircraft industry, space technology or ultra-high vacuum.

BACKGROUND OF THE INVENTION

Following carbon fullerenes and carbon nanotubes (Iijima S, Helical microtubules of graphitic carbon, *Nature* 354, 56–58 (1991); Kroto H W et al., $C_{60}$: Buckminsterfullerene, *Nature* 318, 162–163 (1985)) hollow nanoparticles and nanotubes of metal dichalcogenides, boron-carbides and other layered compounds have been synthesized as a single phase in recent years (Chopra N G, et al., Boron nitride nanotubes, *Science*, 269, 966–967 (1995); Feldman Y, et al., High-rate, gas-phase growth of $MoS_2$ nested inorganic fullerenes and nanotubes, *Science*, 267, 222–225 (1995); Rothschild A, et al., The growth of $WS_2$ nanotubes phases *J An. Chem. Soc*, 122, 5169–5179 (2000); Tenne R, et al., Polyhedral and Cylindrical Structures of $WS_2$. *Nature* 360: 444–445 (1992)). These materials were designated under the generic name inorganic fullerene-like materials (IF).

The tribological properties of solid lubricants such as graphite and the metal dichalcogenides $MX_2$ (where M is molybdenum or tungsten and X is sulphur or selenium) are of technological interest for reducing wear in circumstances where liquid lubricants are impractical, such as in space technology, ultra-high vacuum or automotive transport. These materials are characterized by weak interatomic interactions (van der Waals forces) between their layered structures, allowing easy, low-strength shearing.

Solid lubricants are required to have certain properties, such as low surface energy, high chemical stability, weak intermolecular bonding, good transfer film forming capability and high load bearing capacity. Conventional solid lubricants such as $MoS_2$ particles, graphite, and polytetrafluoroethylene (PTFE) have weak interlayer bonding which facilitate transfer of said materials to lo the mating surface. Such transfer films are partially responsible for low friction and wear.

The use of metal dichalcogenides and $MoS_2$ particles as solid lubricants in various applications, is well documented (Singer I L, in *Fundamentals of Friction: Macroscopic and Microscopic Processes* (eds. 3. Singer I L and Pollock H M), p. 237 (Kluwer, Dordrecht, 1992)). Recently, the tribological applications of hollow nanoparticles of $WS_2$ as an additive for lubrication fluids, has also been demonstrated (Rapoport L, et al., Hollow nanoparticles of $WS_2$ as potential solid-state lubricants, *Nature*, 387, 791–793 (1997).

SUMMARY OF THE INVENTION

It is an object of the present invention to develop new composites of metal, metal alloy or semiconducting material, providing high durability and mechanical strength.

The above object is achieved by the present invention, which provides new composite materials for use to reduce friction coefficient and wear rates and for increasing the load bearing capacity of parts made of such materials. The new composite materials of the invention comprise a porous matrix made of metal, metal alloy or semiconducting material and hollow fullerene-like nanoparticles (IF) of a metal chalcogenide compound or mixture of such compounds, said composite materials having a porosity between about 10% and about 40%.

The present invention also provides a method for preparing the new composite materials of the invention.

The IF nanoparticles used in the composite materials of the invention have a diameter between about 10 and about 200 nm. In view of their small sizes, these nanoparticles can be impregnated into highly densified matrices.

Without being bound to theory, it is suggested that the IF nanoparticles are impregnated into the pores of the porous matrix and are slowly released to the surface, where they serve as both lubricant and spacer. The behavior of IF nanoparticles is compared hereinafter with commercially available $WS_2$ and $MoS_2$ platelets with 2H polytype structure (2H).

BRIEF DESCRIPTION OF THE DRAWINGS

In order to understand the invention and to see how it may be carried out in practice, a preferred embodiment will now be described, by way of non-limiting example only, with reference to the accompanying drawings, in which.

DETAILED DESCRIPTION OF A PREFERRED EMBODIMENT

Figure 1A:
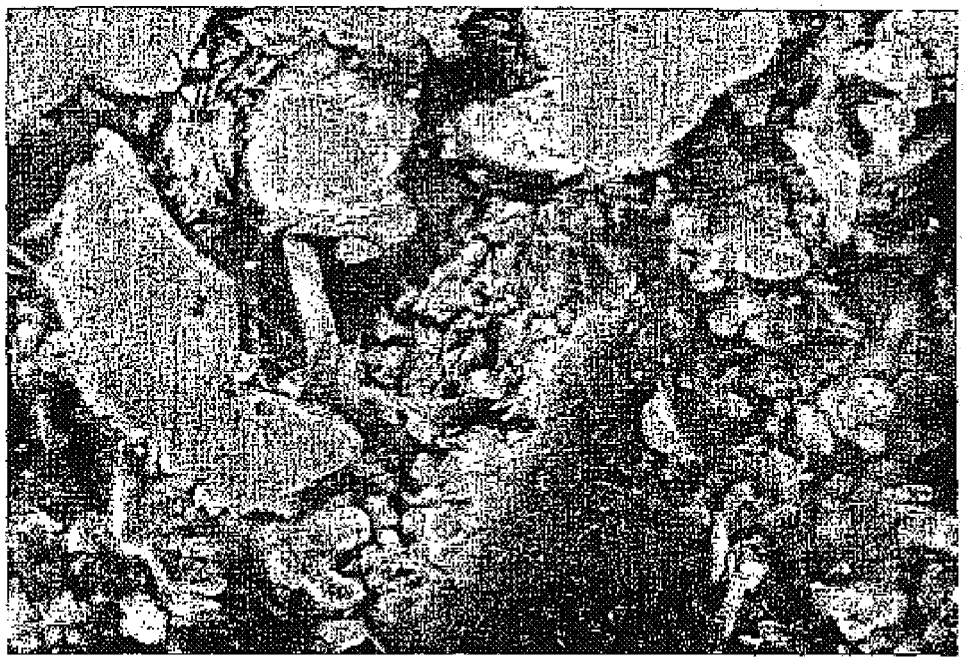
FIGS. 1A and 1B illustrate, respectively, a. SEM image of the sintered bronze-graphite block with 2H-$WS_2$ platelets, and a SEM image of the sintered bronze-graphite block with IF-$WS_2$ nanoparticles.

The present invention provides a new composite material comprising a porous matrix made of metal, metal alloy or semiconducting material and hollow fullerene-like nanoparticles of a metal chalcogenide compound or mixture of such compounds. The composite material is characterized by having a porosity between about 10% and about 40%. The amount of the hallow nanoparticles in the composite material is 1–20 wt. %.

It is suggested that the pores of the matrix serve as a reservoir for the IF nanoparticles, which are slowly furnished to the metal surface providing low friction, low wear-rate and high critical load of seizure in comparison to 2H particles. Most likely, the main favorable contributions of the IF nanoparticles stem from the following three effects: a. rolling friction; b. the hollow nanoparticles serve as spacer, which eliminate metal to metal contact; c. ird body material transfer, i.e. layers of nanoparticles are transferred from time to time from the nanoparticles onto the metal surfaces and they provide a reduced sliding friction between the matting metal surfaces.

Hollow fullerene-like nanoparticles are preferably made of $WS_2$, $MoS_2$ or mixtures thereof. They can be made as small as needed and they possess a non-reactive surface and therefore they can be easily impregnated into the matrix. Since the size of the synthesized IF nanoparticles can be varied between 10 and 200 nm, the relationship between the pores and the nanoparticle sizes can be varied according to the application.

At times, the fullerene-like nanoparticles are mixed with an organic fluid or mixture of organic fluids such as oil, molten wax, etc. prior to adding them to the porous matrix.

The porous matrix is made of a metal, metal alloy or semiconducting material, for example copper and copper-based alloys, iron, and iron-based alloys, titanium and titanium-based alloys, nickel-based alloys, silicon and aluminum.

Numerous applications for the IF nanoparticles in reducing friction and wear can be envisaged. Such an application is for example in sliding bearings.

Sliding bearing are routinely used in places where ball-bearings are prohibitive due to weight saving considerations, like car and other automotive engines, transmission systems, pumps, aerospace and numerous other applications. Unfortunately, the friction losses of sliding bearings are bigger than those found for ball bearings. The composite of the invention combines the advantages of the two technologies. Here, the hollow nanoparticles serve as nanoball bearings and thereby reduce frictions to levels comparable with those found in ball bearings, but with the additional weight savings benefit typical of sliding bearings and without sacrificing the mechanical properties of the metal part.

The growth mechanism of $WS_2$ fullerene-like nanoparticles has been described in the literature, see for example Y. Feldman et al., *J. Am. Chem. Soc.* 1998, 120, 4176. The reaction is carried out in a fluidized bed reactor, where $H_2S$ and $H_2$ react with $WO_3$ nanoparticles at 850° C. A closed WS2 monoatomic layer is formed instantaneously and the core of the nanoparticle is being reduced to $WO_{3-x}$. The enfolding sulfide layer prevents the sintering of the nanoparticles. In the ensuing step, sulfur diffuses slowly into the oxide core and reacts with the oxide. The oxygen atoms out diffuse and progressively closed $WS_2$ layers replace the entire oxide core. After a few hours reaction, nested and hollow $WS_2$ nanoparticles of a diameter$\leqq$200 nm are obtained.

The method of preparing the composite materials of the invention comprises the following steps:

i. preparing a porous matrix by mixing the precursor material for the desired matrix with foaming agents and compaction;

ii. volatilizing the foaming agents under a temperature of about 500° C. and sintering the matrix obtained under a temperature between 700 and 2000° C.;

iii. heating said matrix to a temperature between about 20° C. to about 150° C. under vacuum;

iv. exposing the matrix obtained in step iii above to a source material of hollow nanoparticles of a metal chalcogenide compound or mixture of such compounds in a carrier fluid under vacuum to obtain a composite comprising of said porous matrix impregnated with hollow nanoparticles of a metal chalcogenide or mixture of metal chalcogenides; and v. optionally drying the impregnated porous matrix obtained in step iv to eliminate the organic fluid whenever this fluid is undesireable.

More specifically, the porous matrix used in step i above is produced by introducing organic materials such as foaming agents into a powder of the desired metal or metal alloy and then heating the obtained mixture. The heating cycle includes: volatilizing the organic materials, i.e. the foaming agents, and sintering of the mixture. The foaming agents were evaporated during the sintering step, by heating the matrix to about 500° C. for 30 min. The sintering was carried out under a protective hydrogen atmosphere at a temperature of between 500° and 2000° C., according to the metal or metal alloy powders used. By this procedure, different matrices were obtained with various values of porosity (30–60%).

In the next step, the porous matrix obtained is exposed to a source material of hollow nanoparticles of a metal chalcogenide compound or mixture of such compounds. IF-$WS_2$ or $MoS_2$ nanoparticles, with a diameter of between 10 and 200 nm were applied as solid lubricants. For comparison tests, $WS_2$ and $MoS_2$ particles (2H) with average size close to 4 $\mu$m were applied as solid lubricants. A well mixed suspension of an organic fluid such as a mineral oil, wax, etc and the solid lubricant (content of 10–15%) was vacuum impregnated into the porous materials at a temperature range of 20–150° C. For comparison tests, some of the samples were oil dried after impregnation.

The impregnated porous matrix obtained is optionally dried to achieve a controlled amount of carrier fluid with hollow nanoparticles in the matrix. The matrix obtained has a porosity of 10–40%. When desired, the matrix may optionally be repressed.

The invention will now be further described by the following non-limiting examples.

EXAMPLE 1

Some metal powders, providing low friction (used in self-lubricating sliding bearings like bronze, bronze-graphite, ferrous-graphite and other alloys and composites), were agitated with low melting point organic materials, like carbomethyl cellulose, which contribute to the pore formation and then were pressed in cold state. In this case the samples of bronze-graphite were sintered in hydrogen atmosphere at 750° C. Subsequently, oil impregnated with 2H-$WS_2$ and IF-$WS_2$ nanoparticles were carried-out into the porous metal matrixes in vacuum. Afterwards, the samples were dried at 100° C. in order to exclude the lubricant and other additives. Finally, the samples were repressed up to a porosity of 25–30%. The composition of the metal powder is as follows: Cu-86.4%; Sn-9.6%; graphite 4%.

Figure 1B:
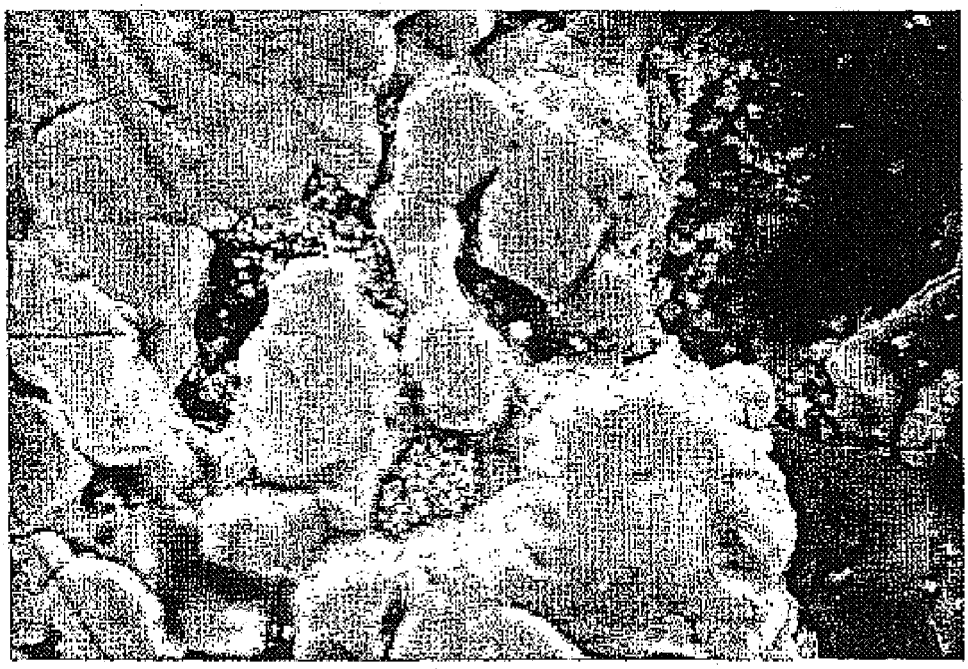

FIGS. 1A and 1B show images of metal surfaces acquired with a Scanning Electron Microscope (SEM). FIG. 1A is the SEM image of a sintered bronze-graphite block with 2H-$WS_2$ platelets. Most of the platelets are standing edge-on, "glued" to the metal surface through their reactive prismatic (10⊠0) faces (shown by arrows). SEM analysis showed a non-uniform distribution of the 2H platelets on the surface of the metal matrix. The sticking ("gluing") of the prismatic edges of the 2H platelets to the metal surface averts their permeation deep into the metal piece and leads to their accumulation at the metal surface. In accordance with the results of this experiment their tribological effect is expected to deteriorate faster with time. Contrarily, the IF-$WS_2$ nanoparticles are distributed quite randomly in the porous metal matrix (FIG. 1B) . . . , The slippery nature of the IF nanoparticles is appeared to lead to their random distribution in the porous metal matrix usually as agglomerates. These softly bonded agglomerates decompose easily into separate IF nanoparticles under light load. EDS analysis confirmes the presence of IF nanoparticles inside the pores.

EXAMPLE 2

Figure 2:
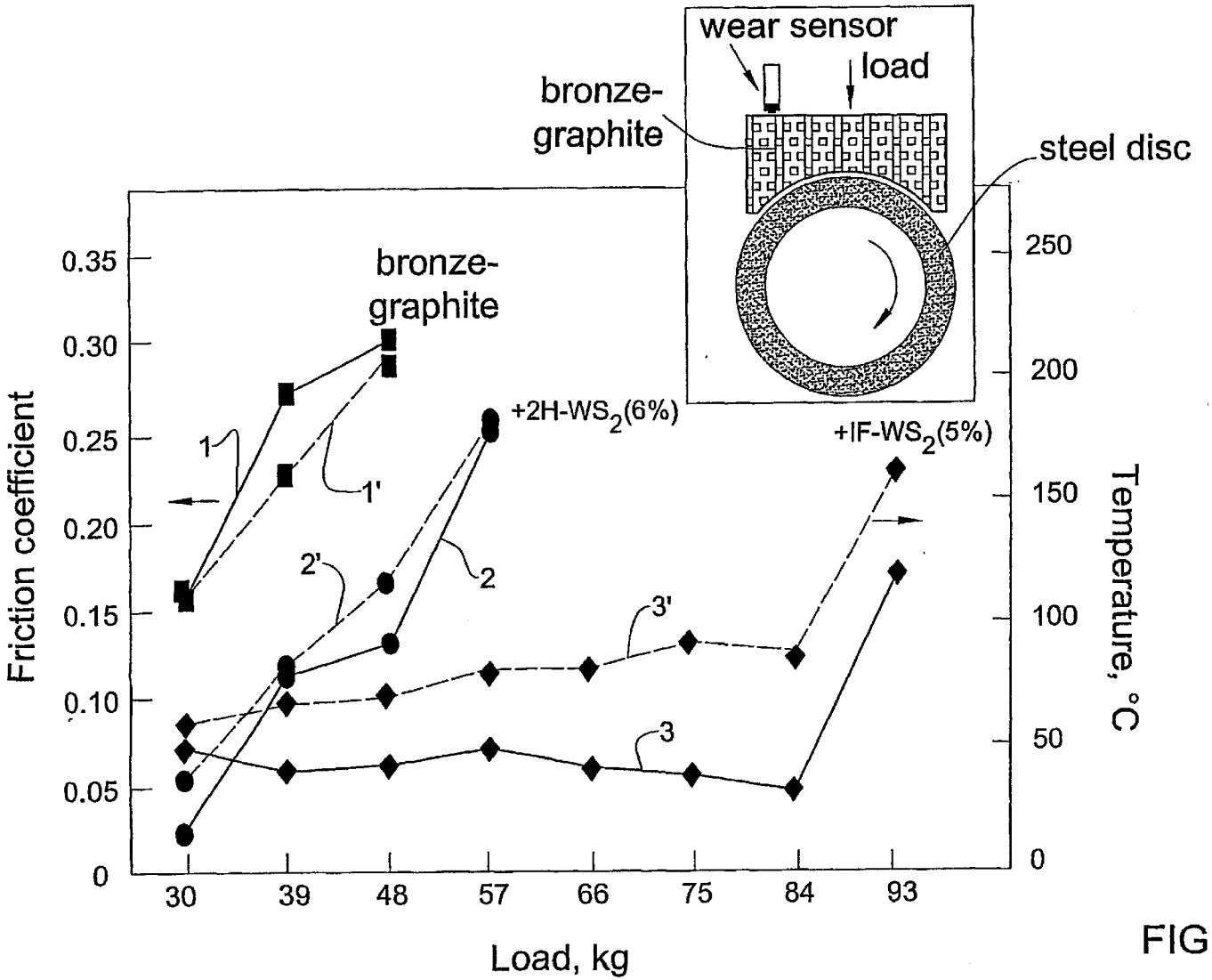
FIG. 2 is a graphical illustration of the dependences of the friction coefficient and temperature on the load exerted on bronze-graphite; bronze-graphite impregnated with 2H-$WS_2$ and IF-$WS_2$ nanoparticles.
Figure 3A:
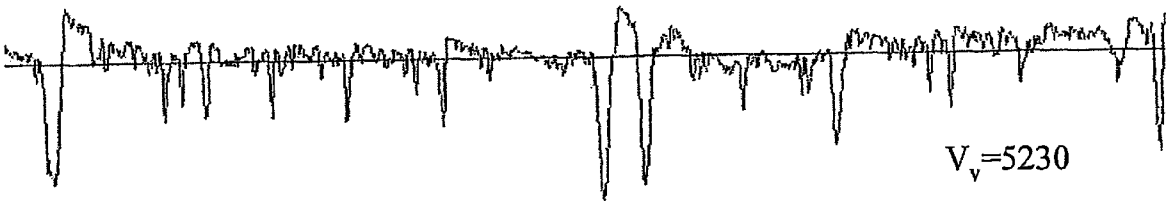
FIG. 3 is a graphical illustration of roughness of the surfaces of 4 bronze-graphite samples (virgin, with oil, with oil and 2H-$WS_2$ and oil with IF-$WS_2$ nanoparticles) after friction under load of 30 kg and sliding velocity of 1 m/s.
Figure 3B:
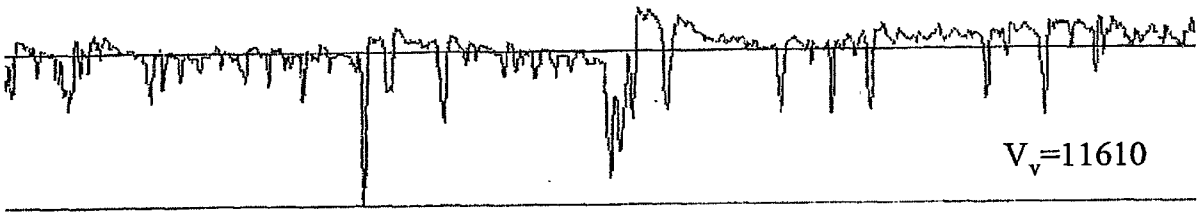
Figure 3C:
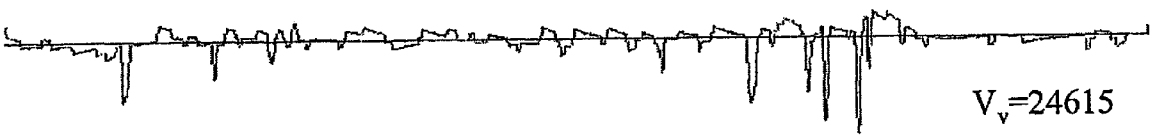
Figure 3D:
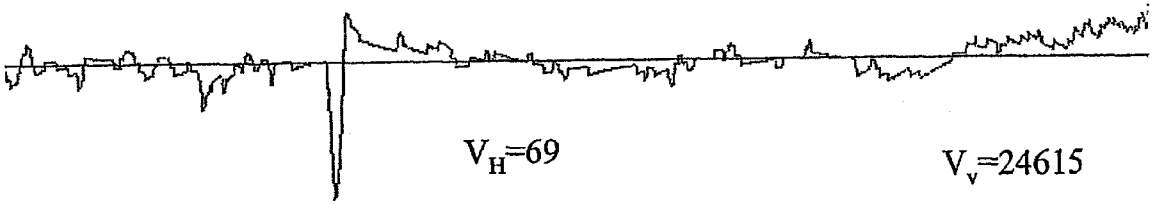

FIG. 2 illustrates the effect of load (in kg) on friction coefficient (1,2,3) and temperature (1',2',3') of oil-dried porous bronze-graphite block against hardened steel disk (HRC 52). In these experiments, after a run-in period of 10–30 hours, the samples were tested under a load of 30 kg and sliding velocity of 1 m/s for 11 hr. Subsequently, the loads were increased from 30 kg with an increment of 9 kg and remained 1 hr under each load. (1,1') reference sample; (2,2') matrix with 2H-$WS_2$ (6 wt. %) (3,3') matrix with (5 wt %) IF-$WS_2$ nanoparticles. The average roughness (Ra) values (in $\mu$m) were: virgin surfaces-2; bronze-graphite+2H-$WS_2$ platelets-0.28; bronze-graphite+IF-$WS_2$ nanoparticles-0.75.

For low loads, all the sintered samples exhibit relatively low friction coefficient. As the load increases beyond a certain critical value, the friction coefficient and temperature increase abruptly, signifying the seizure of the friction pair.

The following values of wear coefficients were obtained under load of 30 kg and sliding velocity of 1 m/s: the wear coefficient (Kw[$mm^3$/mm.N.$10^{-10}$]) was 8.9,3.3, and 2 for bronze-graphite, bronze-graphite with 2H-$WS_2$ and bronze-graphite with IF-$WS_2$ nanoparticles, respectively.

Most remarkably, while the 2H-$WS_2$ platelets increase the critical load rather modestly, the IF-$WS_2$ nanoparticles increase this point from ca. 35 kg to 85 kg. SEM micrographs taken after these tests showed, that the surface of sintered material did not change dramatically following the experiment with the nanoparticles, and the virgin pores are mainly preserved on the contact surface. Furthermore, the spherical nanoparticles can be easily discerned within the pores. On the other hand, the surface of the reference bronze-graphite block or with 2H-$WS_2$ particles added, suffered severe wear. In this case, the surface became rather smooth, as a result of the transfer of wear debris into the pores. A tip profiler was used to examine the surface roughness before and after the tribological tests.

The results of this analysis are summarized in FIG. 3, and they confirm the SEM observations. Using energy dispersive X-ray analysis (EDS), severe oxidation of the wear metal was found for the wear surfaces, while the nanoparticles-containing composite remained mostly unoxidized.

A similar experiment was performed with $MoS_2$ nanoparticles used as solid lubricant. The experiment was carried out according to the same procedure of Example 2. The friction coefficient in the steady friction sate was 0.035 for the IF-$MoS_2$ and 2H-$MoS_2$ impregnated samples. The critical load for the transition to seizure was higher for the IF-$MoS_2$ than for the IF-$WS_2$ sample and was 120 kg.

EXAMPLE 3

In another series of experiments, the lifetime of the metal piece with and without the solid lubricant was compared under relatively harsh conditions. After a run-in period similar to the one used in the previous experiments, the load was gradually increased to 60 kg at sliding velocity of 1 m/s. The lifetime of the metal piece containing 6 wt. % of 2H-$WS_2$ platelets was found to be less than one hour before seizure took place. Under the same conditions, the metal piece containing 5 wt. % IF-$WS_2$ survived for 18 hours before seizure, i.e. 20 times improvement in the lifetime of the metal piece. The dry metal-piece seized before this load could be reached (after the run-in period). These results are consistent with the previous results and they allude to the substantial gains in lifetime of metal pieces impregnated with such tiny amount of the hollow nanoparticles.

EXAMPLE 4

Figure 4:
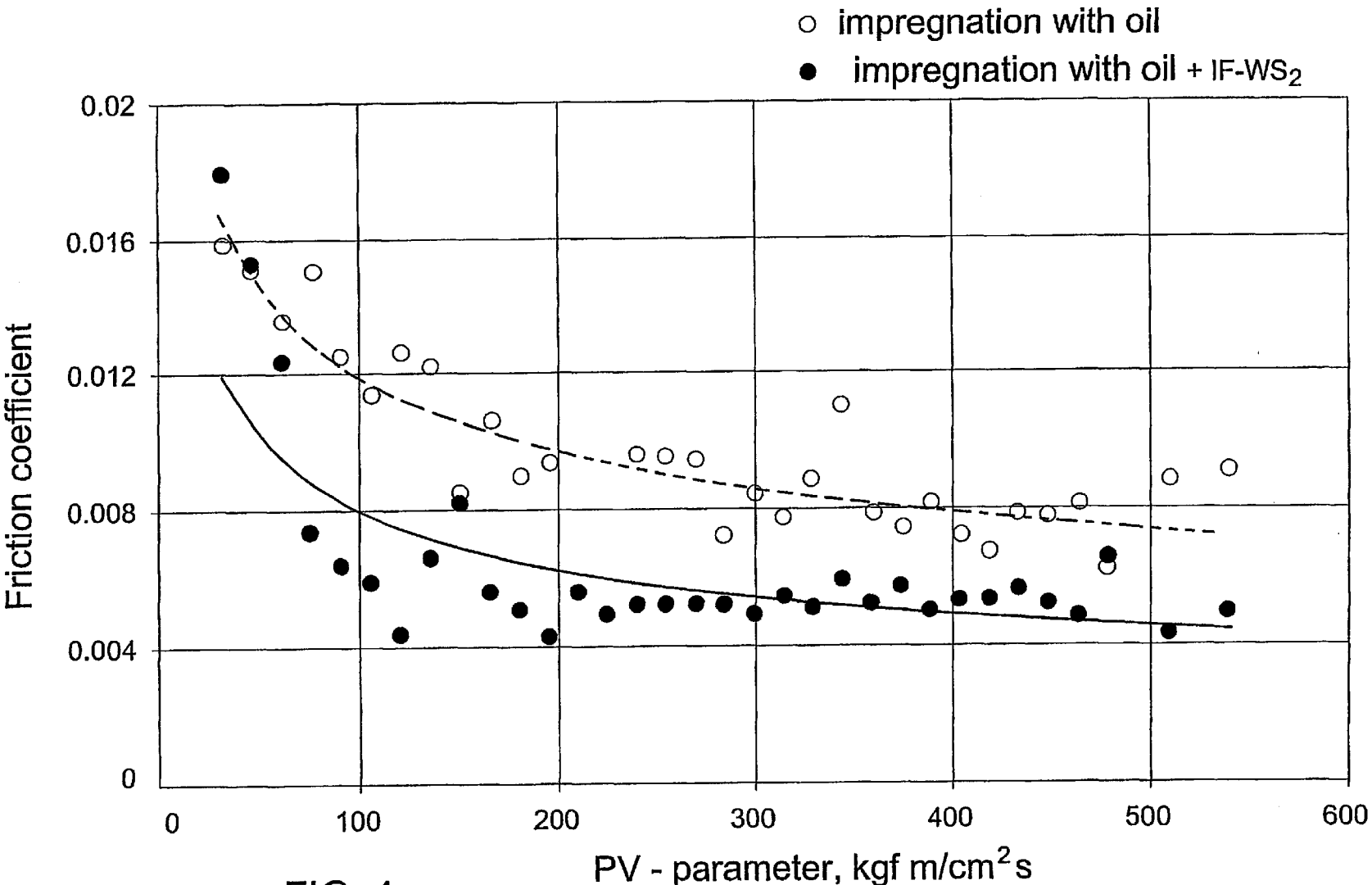
FIG. 4 is a graphical illustration of the friction coefficient of bronze-graphite composites as a function of the PV parameter with oil and oil+IF-$WS_2$ (3.2 wt. %) nanoparticles.

Bronze composites were chosen for this experiment. In this case the friction and wear behavior of the well-known oil-impregnated bronze was compared with the samples impregnated with oil+ solid lubricant suspensions. A well mixed suspension of mineral oil with the solid lubricant was vacuum impregnated into the porous materials. The quantity of the solid lubricant impregnated into the porous matrix was 3.2 wt. %. The final value of the matrix porosity was about 27–30%. The tests were performed at laboratory atmosphere (~50% humidity) using a ring-block tester at loads of 150–3000 N. The sliding speed was changed every half an hour in steps of 0.2 m/s from 0.5 to 1.7 m/s under a definite load. Then, the cycle of increasing sliding speed was repeated under the next load. The load was increased by steps of 150 N. All the experimental points measured were presented as PV parameter, i.e. pressure× velocity. FIG. 4 shows the friction coefficient of the metal matrix as a function of the PV parameter of the metal piece with and without the addition of the fullerene-like $WS_2$ nanoparticles.

Figure 5:
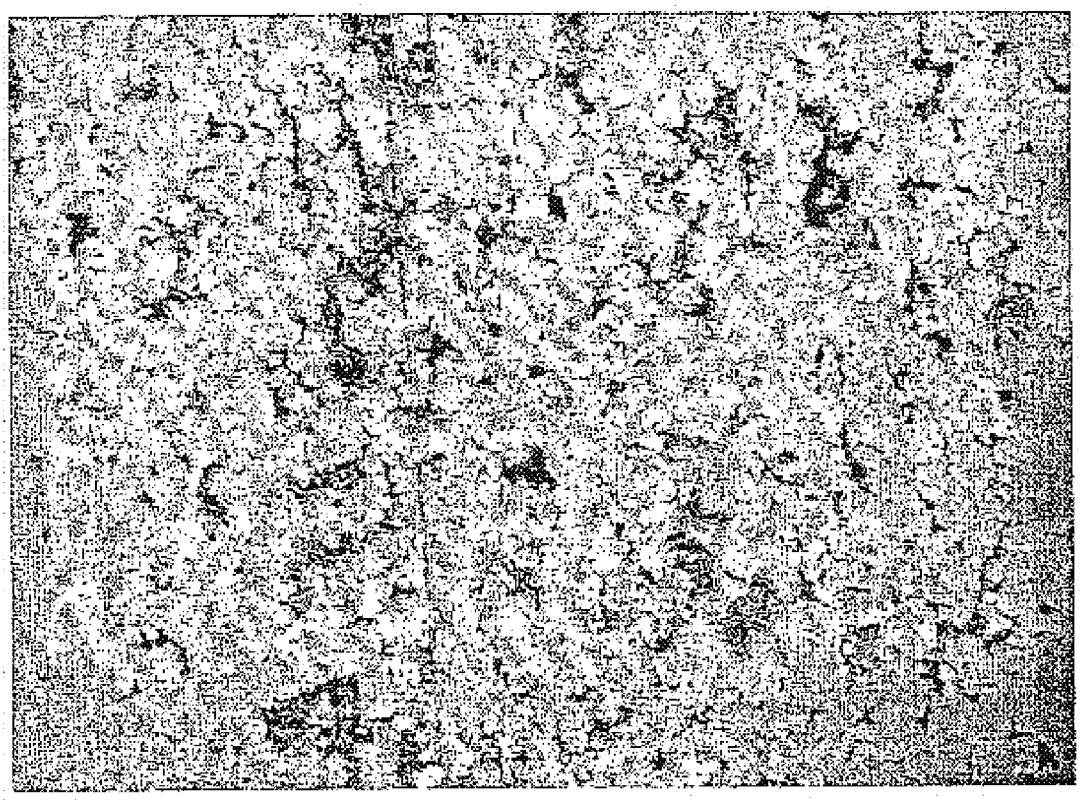
FIG. 5 illustrates a SEM image of the surface of powdered bronze-graphite block impregnated with oil+IF after the test under PV=5200.

The addition of the IF nanoparticles to the oil leads to a decrease of the friction coefficient by 30–50% as compared to the oil impregnated surfaces. The average values of the friction coefficient for samples with oil and oil+IF were 0.009 and 0.005, respectively. The powdered block with oil+IF suspension showed very high load bearing capacity, PV>5200 Nm/($cm^2$s). FIG. 5 shows the surface of block impregnated with oil+IF after the test under PV=5200. The porous surface without the ploughing and adhered wear particles testifies good friction conditions.

EXAMPLE 5

This example describes the sintering of iron-nickel-graphite powdered samples impregnated with IF nanoparticles after oil drying and their tribological properties.

Figure 6:
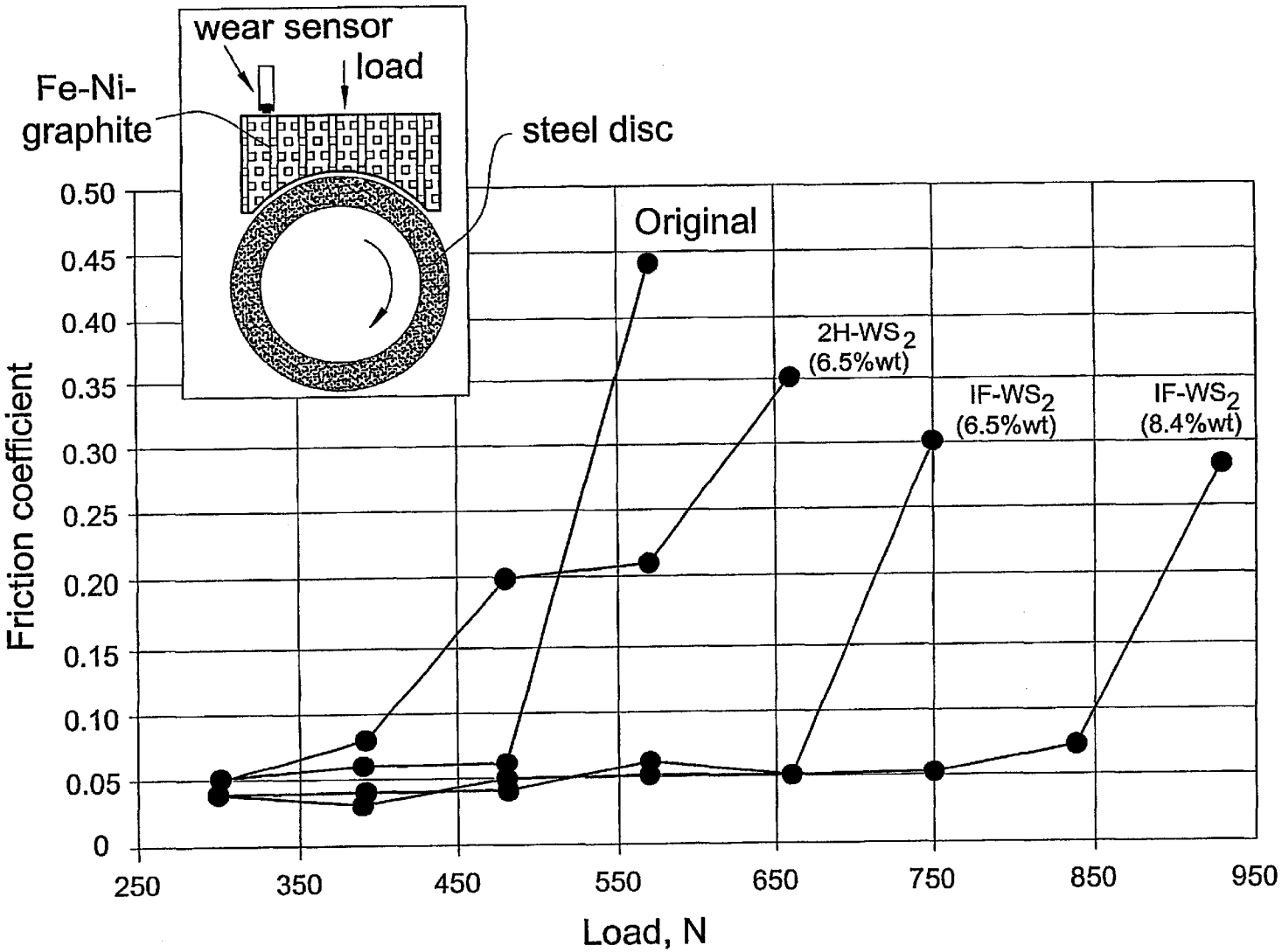
FIG. 6 is a graphical illustration of the correlation between the friction coefficient and the load for iron-nickel-graphite block impregnated with 2H-$WS_2$, 6.5 wt % and IF-$WS_2$, 6.5 and 8.4 wt %, after oil drying.

Sintering of the specimens was carried out in a protective hydrogen atmosphere at a temperature of 1050° C. The amount of the solid lubricant impregnated into the porous matrix was changed form 6.5 wt % to 8.4 wt %. After impregnation of the IF nanoparticles suspended in oil, the sample was heated to 150° C. for 2 hr in order to remove the excess oil from the metal matrix. The transition to seizure was evaluated in this experiment. The friction and wear test were similar to that described in the example 1. Beyond a certain critical load, the friction coefficient and temperature increased abruptly, signifying the transition to seizure of the mating metal pair. The dependences of the friction coefficient on the load for iron-nickel-graphite block impregnated with oil, oil+2H and oil+IF are presented in FIG. 6. It is seen that the impregnation of IF nanoparticles improves the tribological properties in comparison to the known additives (2H-$WS_2$ and 2H-$MoS_2$).

EXAMPLE 6

This example describes the sintering of iron-graphite powdered samples impregnated with IF nanoparticles and their tribological properties.

Figure 7:
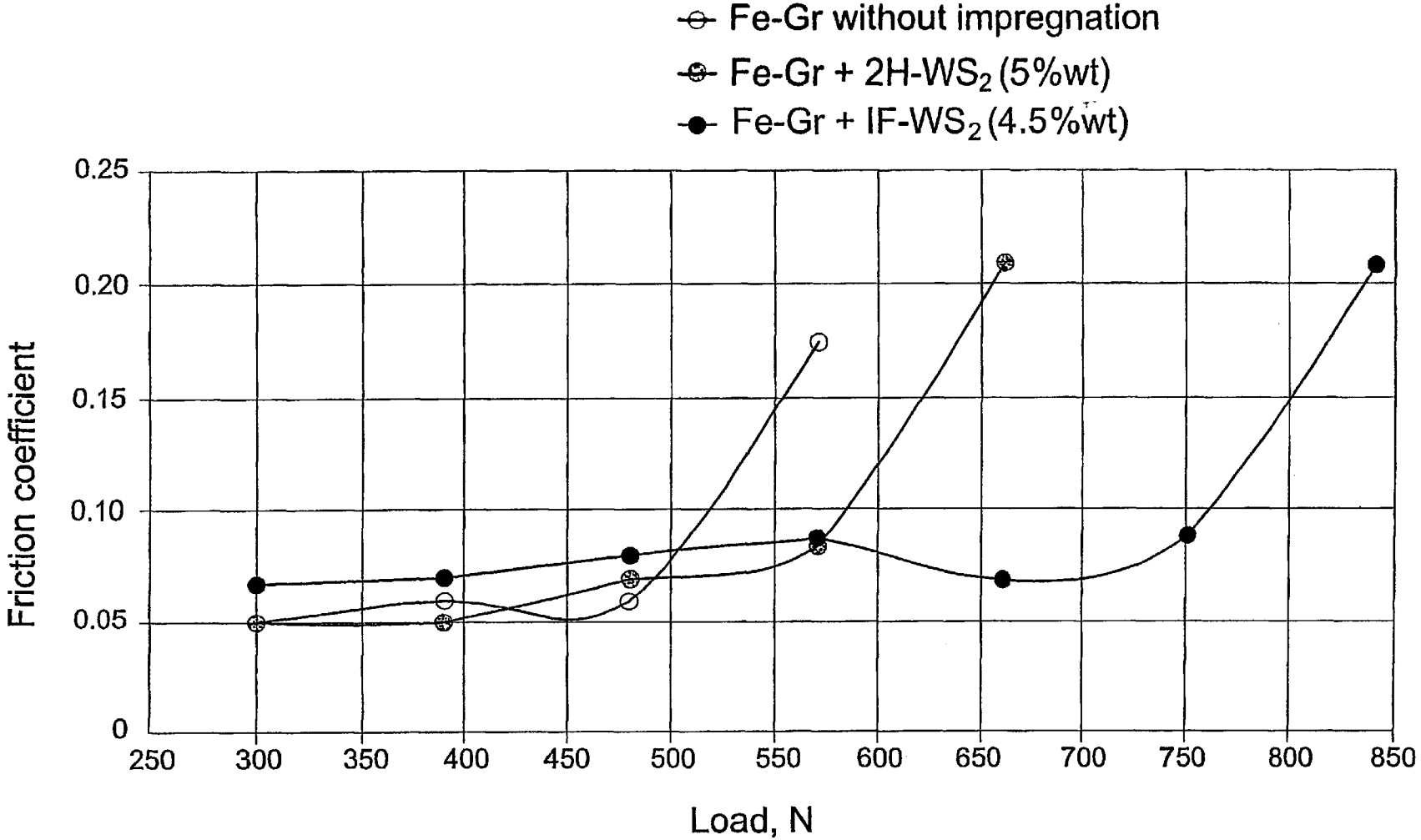
FIG. 7 is a graphical illustration of the correlation between friction coefficient and the load for iron-graphite block impregnated with 2H-$WS_2$ (5 wt. %) and IF-$WS_2$ (4.5 wt %).) after oil drying.

Sintering and preparation of the sample to the tribological tests was similar to example 1. The transition to seizure was evaluated in this experiment. The friction and wear tests were similar to that described in the example 1. Beyond a certain critical load, the friction coefficient and temperature increased abruptly, signifying the transition to seizure of the mating metal pair. The dependences of the friction coefficient on the load for iron-nickel-graphite block impregnated with oil, oil+2H (5 wt. %) and oil+IF (4.5 wt. %) are presented in FIG. 7. It is seen that the impregnation of IF nanoparticles improves the tribological properties in comparison to known additives.

EXAMPLE 7

This example concerns the impregnation of IF nanoparticles with a molten paraffin wax into the porous matrix of bronze-graphite sample and the tribological measurements of this sample. Sintering and preparation of the sample and the tribological tests were similar to examples 1, 2. The results are presented in Table 1.

TABLE 1

| | Friction coefficient, $f$ | Wear coefficient, $10^{-11}$, $mm^3/mm\ N$ | Critical load, P, N |
|---|---|---|---|
| Paraffin wax | 0.017 | 22.9 | 660 |
| Paraffin wax + 2 H | 0.01 | 14.6 | 1020 |
| Paraffin wax + IF | 0.007 | 13.4 | 1380 |

It may be seen that addition of paraffin wax into the porous matrix provides a very low friction coefficient in comparison to the sample with IF nanoparticles impregnated after oil drying (f=0.05). The critical load of transition to seizure for the sample with paraffin wax+IF (P=1380 N) is substantially higher than for oil-dried sample with IF nanoparticles (P=850 N).

EXAMPLE 8

A porous silicon substrate was prepared by anodizing Sb doped Si (n-type) wafer for 40 min in $HF/H_2O$ mixture of 10% under illumination of quartz-halogen lamp (80 $mW/cm^2$) which produced an anodic current of 15 $mA/cm^2$. The anodized wafer was flushed and dipped into KOH solution (1 M) in order to dissolve the nanoporous film and leave the macroporous top surface exposed to the outer surface. The treated Si wafer was examined by scanning electron microscope (SEM) and was found to include a dense pattern of pores with cross-section diameter of between 0.1–1 micron. By cleaving the Si wafer, the porous layer was found to extend to about 10 micron deep. This means that the top surface of the porous Si can be regarded as a suitable host to the nanoparticles of the fullerene-like material and substantial reduction in friction could be anticipated. Since, the depth of the pores could be determined essentially through the electrochemical parameters of the reaction; the host structure could be extended to anywhere between 0.5 micron to 100 micron and more.

The Si wafer ($1\times0.5\ cm^2$) sample was placed in the disc-block tester and the tribological parameters were measured under a load of 20 kg and a velocity of 0.4 m/s. A stainless steel disc was used for these measurements. When the dry Si was tested, a friction coefficient of 0.24 was measured. When mineral oil was added between the Si wafer and the metal disc, the friction coefficient went down to 0.108. Then mineral oil with 2% of the IF-$WS_2$ was used as a lubricant instead of the pure oil. After a short run-in period, a friction coefficient of 0.03 was obtained. After the measurements, the Si wafer was examined by a SEM and a black powder chemically identified as $WS_2$ was found by EDS analysis in the macropores of the Si wafer. This shows that during the run-in period, the fullerene-like nanoparticles were inserted into the pores of the porous Si, as was further confirmed by a careful transmission electron microscopy analysis.

EXAMPLE 9

Porous aluminium membrane with pore diameters of between 0.05–0.5 micron was purchased. Alternatively, an aluminum foil was anodized in HF/H2O mixture (10%) and a porous aluminium membrane with similar porosity was obtained. Measurements analogous to Example 4 were performed with these porous samples. Very high friction coefficients (>0.4) were determined with the dry aluminium membrane surface. By adding the oil, the friction coefficient went down to 0.14 and by adding 2% of the fullerene-like $WS_2$ (IF-$WS_2$) nanoparticles, a friction coefficient of 0.012 was obtained after a short run-in period. As for the case of Example 4, the IF-$WS_2$ nanoparticles were found to accumulate in the pores of the aluminium membrane and alleviate the high friction of the sample surface. The wear coefficient was measured as well. It went down by a factor of 25 between the surface lubricated with pure oil and that lubricated by pure oil and 2% IF material. These results indicate the life expectancy of the two surfaces. The wear coefficient of the dry sample could not be measured since this is a brittle material and it deteriorates after a very short period of loading.

What is claimed is:

1. A composite material comprising a porous matrix made of metal, metal alloy or semiconducting material and hollow fullerene-like nanoparticles of a metal chalcogenide compound or mixture of such compounds, said composite material having a porosity between about 10% and about 40%.

2. A composite according to claim 1, wherein said nanoparticles are impregnated into the pores of said porous matrix.

3. A composite according to claim 1, wherein said hollow nanoparticles are made of $WS_2$, $MoS_2$ or mixtures thereof.

4. A composite according to claim 3, wherein the diameter of said nanoparticles is between about 10 and about 200 nm.

5. A composite according to claim 1 wherein the amount of the hollow nanoparticles in said matrix is between about 1% and about 20 wt. %.

6. A composite according to claim 1, wherein the fullerene-like nanoparticles are mixed with an organic carrier fluid or mixture of organic carrier fluids.

7. A composite according to claim 1, wherein the fullerene-like nanoparticles are mixed with an oil or mixture of oils as carrier fluid.

8. A composite according to claim 1 wherein said porous matrix is selected from the group consisting of copper, and copper-based alloys, iron, and iron-based alloys, titanium and titanium-based alloys, nickel-based alloys, silicon, and aluminium.

9. A composite according to claim 8, wherein the porous matrix is a doped silicon substrate anodized in HF containing solutions.

10. A composite according to claim 8, wherein the porous matrix is an aluminum foil anodized in acidic solution.

11. A composite according to claim 1 for use in reducing friction coefficient and wear rates and increasing the load bearing capacity of articles manufactured from such composite.

12. A method of reducing the friction coefficient, the wear rate and of increasing the load bearing capacity of a loaded porous matrix selected from metal, metal alloy or semiconducting material, the method comprising: providing a porous matrix from which the piece is produced and adding to said matrix between about 1% and about 20% of hollow nanoparticles of a metal chalcogenide.

13. A method of preparing a composite material as defined in claim 1, the method comprising the following steps:

i. preparing a porous matrix by mixing the precursor material for the desired matrix with foaming agents and compaction;

ii. volatilizing the foaming agents under a temperature of about 500° C. and sintering the matrix obtained under a temperature between 700 and 2000° C.;

iii. heating said matrix to a temperature between about 20° C. to about 150° C. under vacuum;

iv. exposing the matrix obtained in step iii above to a source material of hollow nanoparticles of a metal chalcogenide compound or mixture of such compounds in a carrier fluid under vacuum to obtain a composite comprising of said porous matrix impregnated with hollow nanoparticles of a metal chalcogenide or mixture of metal chalcogenides; and v. optionally drying the impregnated porous matrix obtained in step iv to eliminate the organic fluid whenever this fluid is undesireable.

14. A method according to claim 13, wherein the amount of the hollow nanoparticles in the pores of the matrix is between about 1% and about 20 wt. %.

15. A method according to claim 13, wherein said nanoparticles are added to said porous matrix in step iv by mixing with 5–30 wt % of an organic carrier fluid or mixture of organic fluids.

16. A method according to claim 13, wherein said nanoparticles are added to said porous matrix in step iv by mixing with 5–30 wt % of a carrier oil or mixture of oils.

17. A method according to claim 13, wherein said nanoparticles are added to said porous matrix in step iv by mixing with a molten wax.

* * * * *